United States Patent [19]

Rozmus

[11] Patent Number: 4,526,748

[45] Date of Patent: Jul. 2, 1985

[54] HOT CONSOLIDATION OF POWDER METAL-FLOATING SHAPING INSERTS

[75] Inventor: Walter J. Rozmus, Traverse City, Mich.

[73] Assignee: Kelsey-Hayes Company, Romulus, Mich.

[21] Appl. No.: 397,359

[22] Filed: Jul. 12, 1982

Related U.S. Application Data

[63] Continuation of Ser. No. 152,339, May 22, 1980, abandoned.

[51] Int. Cl.[3] ..... B22F 3/14

[52] U.S. Cl. ..... 419/49; 419/48; 419/8; 428/553

[58] Field of Search ..... 419/48, 49, 8; 428/553

[56] References Cited

U.S. PATENT DOCUMENTS

| | | | |
|---|---|---|---|
| 3,773,506 | 11/1973 | Larker et al. | 419/49 |
| 3,844,778 | 10/1974 | Malone et al. | 419/8 |
| 4,142,888 | 3/1979 | Rozmus | 419/49 |
| 4,255,103 | 3/1981 | Rozmus | 419/49 |

OTHER PUBLICATIONS

Hirschhorn, *Introduction to Powder Metallurgy*, (1969), APMI, pp. 98–107.

*Primary Examiner*—Edward A. Miller
*Assistant Examiner*—Anne Brookes
*Attorney, Agent, or Firm*—Harold W. Milton, Jr.

[57] ABSTRACT

An assembly and method for hot consolidating powder metal by heat and pressure in a container. The container is a mass of material substantially fully dense and incompressible with at least a portion which is capable of plastic flow at pressing temperatures and forming a closed cavity of a predetermined shape and volume for receiving a quantity of powder metal with the interior walls being movable to reduce the volume of the cavity for compacting powder metal into an article. A shaping insert is disposed in the cavity for defining a void in the article as the powder metal is compacted against the shaping insert. A force-responsive means allows relative movement between the shaping insert and at least a portion of the interior walls of the cavity as powder metal is compacted in response to a force reducing the volume of the cavity. In one embodiment the force-responsive means takes the form of a deformable projection extending from the shaping insert into a recess in the cavity whereby the projection will be deformed in response to a predetermined force to allow the shaping insert to move relative to the interior cavity walls. In another embodiment the shaping insert is supported by a press fit whereby the shaping insert is allowed to move in response to a predetermined compacting force. The force applied to the container may be applied by gas pressure in a gas autoclave or by pressing the container to cause plastic flow of the container mass.

3 Claims, 7 Drawing Figures

HOT CONSOLIDATION OF POWDER METAL-FLOATING SHAPING INSERTS

This application is a continuation of application Ser. No. 152,339, now abandoned, filed May 22, 1980.

BACKGROUND OF THE INVENTION (1) Field of the Invention

This invention relates to an assembly and method for forming and subsequently heat treating articles of near net shape from powder metal.

Hot consolidation of metallic, intermetallic, and nonmetallic powders and combinations thereof has become an industry standard. Hot consolidation can be accomplished by filling a container with a powder to be consolidated. The container is usually evacuated prior to filling and then hermetically sealed. Heat and pressure are applied to the filled and sealed container. This can be accomplished by pressing the container between the dies of a press while restraining the container to cause plastic flow of the container mass or it can be accomplished in an autoclave where gas pressure applies pressure over the surface of the container to cause plastic flow of the container material whereby the container shrinks or collapses. As the container shrinks or collapses the powder is densified. In other words, at elevated temperatures, the container functions as a pressure-transmitting medium to subject the powder to the pressure applied to the container. Simultaneously, the heat causes the powder to fuse by sintering. In short, the combination of heat and pressure causes consolidation of the powder into a substantially fully densified and fused mass in which the individual powder particles have lost their identity.

After consolidation, the container is removed from the densified powder compact and the compact is then further processed through one or more steps, such as forging, machining and/or heat treating, to form a finished part.

Due to difficulties encountered in post consolidation processing, efforts have been made to produce "near net shapes". As used herein, a near net shape is a densified powder metal compact having a size and shape which is relatively close to the desired size and shape of the final part. Producing a near net shape reduces the amount of post consolidation processing required to achieve the final part. For example, in many instances, subsequent hot forging may be eliminated and the amount of machining required may be significantly reduced.

(2) Description of the Prior Art

U.S. Pat. No. 4,142,888 granted Mar. 6, 1979 in the name of the inventor of the subject invention discloses a container for hot consolidation of powder wherein the container includes a mass of container material which is substantially fully dense and incompressible and is capable of plastic flow at pressing temperatures. A cavity of a predetermined shape is formed within the mass for receiving a quantity of powder and the mass includes walls around the cavity of sufficient thickness so that the exterior surface of the container does not closely follow the contour of the cavity so that upon application of heat and pressure to the container, the mass acts like a fluid to apply hydrostatic pressure to the powder contained in the cavity. As illustrated in that patent, the volume of the cavity is reduced as the walls of the cavity all move inwardly as the powder is compacted.

It is difficult to make the desired near net shapes when the compact or article has a complex shape. In order to obtain compacts or articles of complex shapes which are of near net shapes, it is sometimes necessary for a shaping portion of the container to extend into the cavity. During compaction this shaping portion moves with the interior walls of the cavity and may cause compaction of the powder on one side of the shaping portion before the compaction on the other thereby preventing the desired near net shape.

SUMMARY OF THE INVENTION

The subject invention provides an assembly and method for consolidating powder by heat and pressure in a container mass which is substantially fully dense and incompressible with at least a portion capable of plastic flow at pressing temperatures and having interior walls forming a closed cavity of a predetermined shape and volume for receiving powder with the interior walls being movable to reduce the volume of the cavity for compacting the powder into an article by a shaping means disposed in the cavity for defining a void in the article as the powder is compacted as a force is applied to the container to reduce the volume of the cavity with a force-responsive means allowing relative movement between the shaping means and at least a portion of the interior walls of the cavity as powder is compacted against the shaping means in response to a force reducing the volume of the cavity. Specifically, the subject invention provides "floating" shaping inserts disposed in the cavity in a container for compacting powder.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENTS

Figure 1:
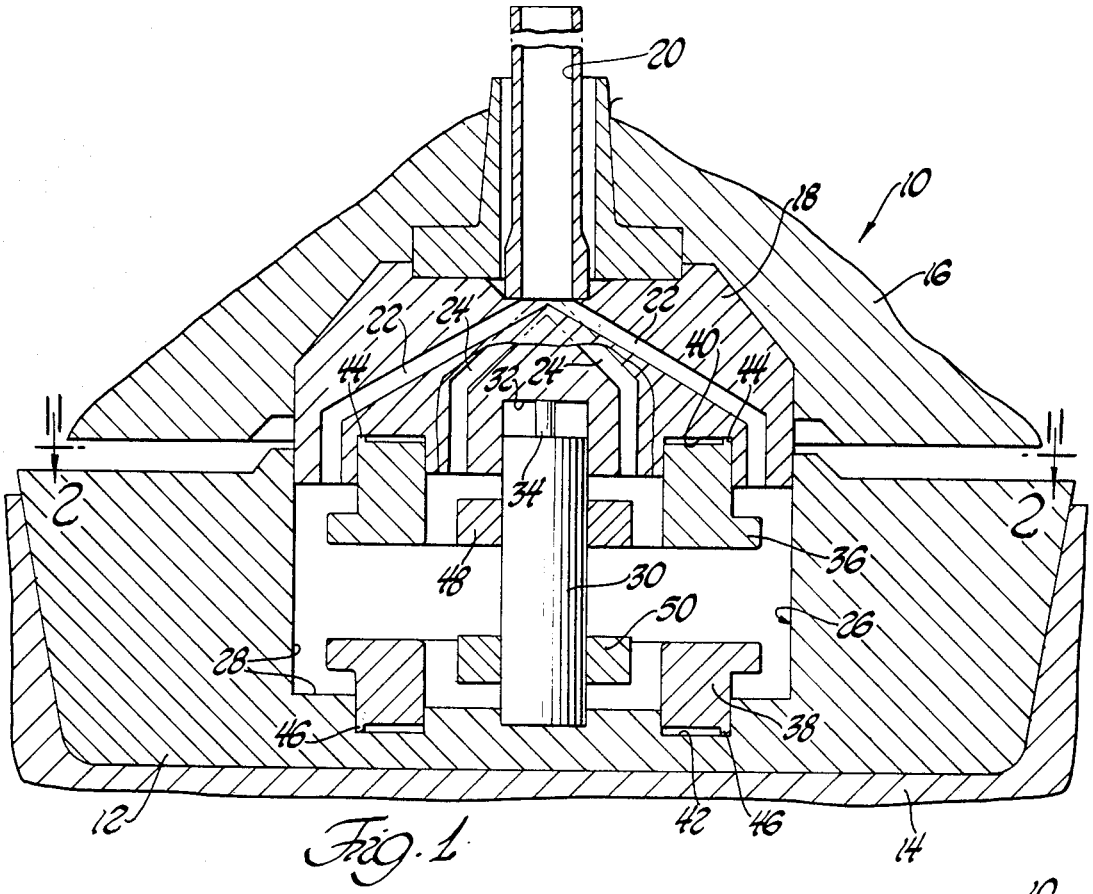
FIG. 1 is a fragmentary cross-sectional view showing a container disposed in a press with the floating shaping inserts of the subject invention disposed in the cavity of the container for compacting the powder in the cavity.
Figure 2:
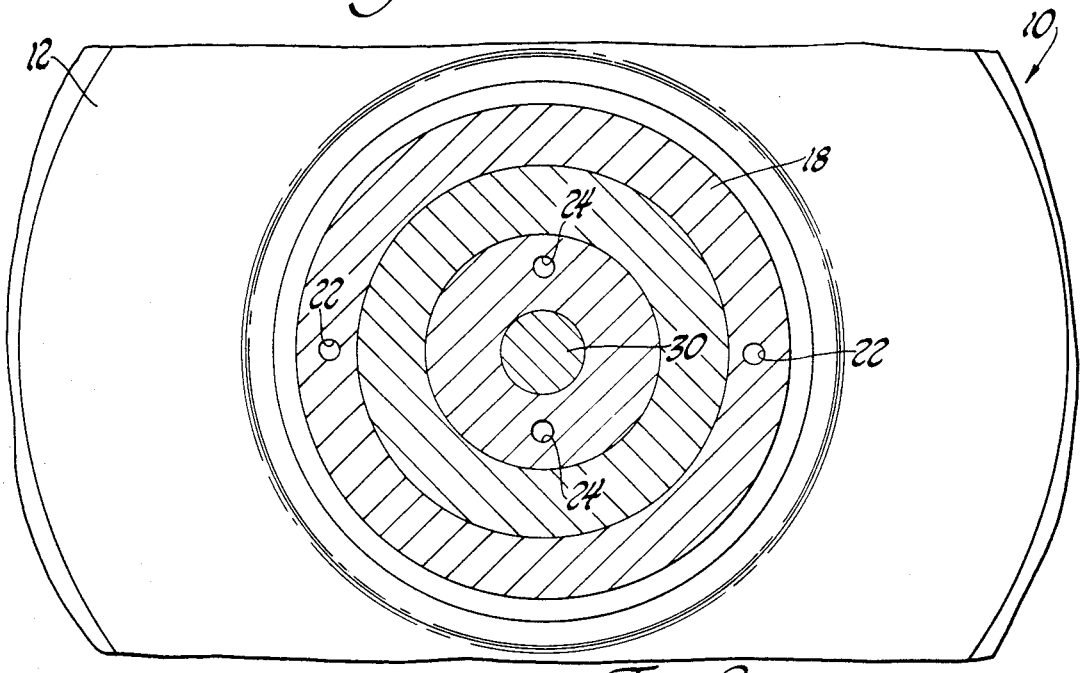
FIG. 2 is a fragmentary view taken substantially along line 2—2 of FIG. 1.
Figure 3:
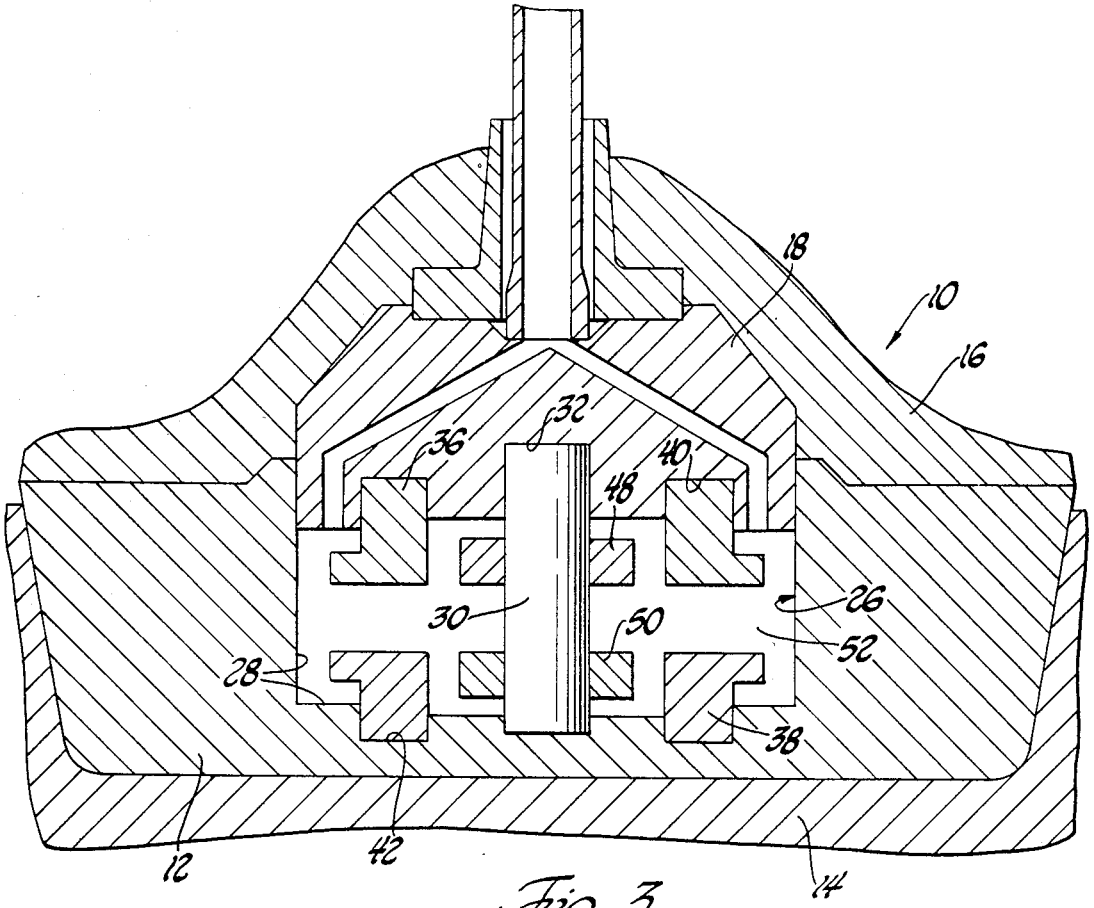
FIG. 3 is a view similar to FIG. 1 but showing the assembly after full compaction and consolidation of the powder has taken place.

An assembly for hot consolidating powder in a container by heat and pressure is generally shown at 10 in FIGS. 1, 2 and 3.

The assembly includes a container 12 defined by a mass of material which is substantially fully dense and incompressible and at least a portion of which is capable of plastic flow at pressing temperatures. The container 12 is disposed between the dies 14 and 16 of a press. Actually, the lower die 14 receives the container 12 in a pocket to restrain the container 12. The upper die 16 is a ram which will engage the top of the container 12 as will become more clear hereinafter. A plug 18 is supported by the upper die or ram 16. The plug 18 includes passages 20, 22 and 24 through which powder flows into a cavity 26. The mass of the container 12 has interior walls 28 which, with the bottom wall of the plug 18, forms or defines the closed cavity 26 of a predetermined shape and volume. The cavity 26 receives a quantity of powder through the passages 20, 22 and 24, the passage 20 being plugged prior to compaction by any one of various known methods.

The interior walls defining the cavity 26, including the walls 28 and the bottom wall of the plug 18, are movable to reduce the volume of the cavity 26 for compacting powder therein into a compact or article. Shaping means are disposed in the cavity for defining a void in the article as the powder is compacted against the shaping means. Further, there is a force-responsive means for allowing relative movement between the shaping means and at least a portion of the interior walls of the cavity 26 as powder is compacted against the shaping means in response to a force reducing the volume of the cavity. The force-responsive means allows relative movement until a predetermined degree of compaction occurs at which point the mass of the container 12 becomes substantially monolithic and further compaction occurs as a result of fluid-like behaviour of the mass of the container 12 due to the plastic flow of the mass of the container 12 whereby further compaction is isostatic. Specifically, the plug 18 is moved downwardly by the ram 16 to compact powder within the cavity 26. Once a predetermined degree of compaction of the powder in the cavity 26 occurs, the ram 16 engages the top of the container 12 and, since the container 12 is constrained within the lower die 14, the container 12 becomes fluid-like in behaviour as plastic flow occurs applying additional compaction forces to the powder within the cavity 26. Once the ram 16 engages the top of the container 12 to cause the plastic flow, the compaction becomes isostatic. The container 12 and the powder in the cavity 26 is heated to a temperature at which the powder in the cavity 26 will densify as pressure is applied to the powder in the cavity 26 as a result of a force applied to the container 12. Initially, as the plug 18 moves into the cavity 26, the compaction is linear or straight line but when the ram 16 engages the container 12 the compaction becomes isostatic as the compaction forces are applied generally in all directions against the compact in the cavity 26.

There are a plurality of shaping means in the cavity 26. The first is a cylindrical shaping insert 30. The interior wall of the cavity 26 defined by the bottom of the plug 18 has a recess 32 therein. The cylindrical shaping insert 30 extends into the recess 32 and is in a close fit with the recess 32 to prevent communication between the cavity and the recess 32. The top of the cylindrical shaping insert 30 is spaced from the bottom of the recess 32. The force-responsive means for allowing the relative movement between the shaping insert 30 and the wall of the cavity defined by the bottom of the plug 18, comprises an integral shaft-like projection 34 disposed in the space between the bottom of the recess 32 and the cylindrical shaping insert 30. The projection 34 is deformable for allowing the space between the bottom of the recess 32 and the top of the cylindrical shaping insert 30 to be reduced in response to a force reducing the volume of the cavity 26.

The shaping means also includes a top annular shaping insert 36 and a bottom annular shaping insert 38. Shaping insert 36 is disposed in an annular recess 40 in the interior wall of the cavity 26 defined by the plug 18. Annular shaping insert 38 is disposed in a recess 42 in the interior wall 28 of the cavity 26. The force-responsive means for allowing relative movement of the shaping insert 36 relative to the interior wall defined by the bottom of the plug 18 comprises an annular deformable rib or projection 44 extending from and integral with the shaping insert 36 to engage the bottom of the recess 40. In a similar fashion, an annular rib or projection 46 is integral with the shaping insert 38 and engages the bottom of the recess 42.

The shaping means further includes the top and bottom ring-like shaping inserts 48 and 50 respectively. The annular rings 48 and 50 are supported by appropriate support means on the cylindrical shaping insert 30 and the support means allows movement of the shaping inserts 48 and 50 in response to a predetermined force. Specifically, the rings 48 and 50 may be press fit upon the cylindrical shaping insert 30.

Figure 4:
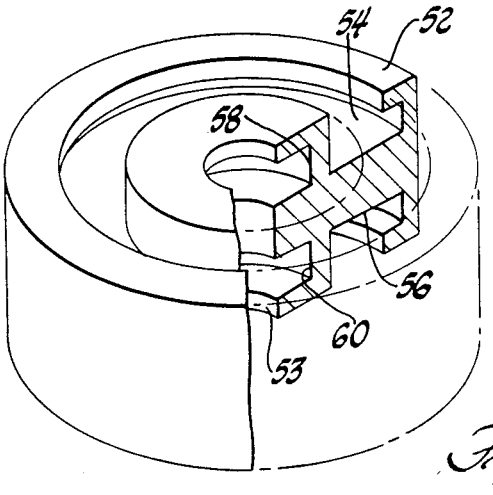
FIG. 4 is a perspective view partially cut away and in cross section of the compact or article removed from the assembly of FIG. 3.

The compact or article resulting from consolidation is shown at 52 in FIGS. 3 and 4. The circular cavity 26 produces the near net shape 52, the near net shape 52 shown in FIG. 4 is after the compact or article has been removed from the container 12 and the shaping inserts 30, 36, 38, 48 and 50 by machining, leaching or one of many known processes. The cylindrical shaping insert 30 forms the cylindrical opening 53 through the compact 52. The annular shaping insert 36 forms the annular recess 54 and associated groove whereas the annular shaping insert 38 forms the oppositely disposed recess 56 and associated groove. The ring-like shaping insert 48 forms the circular groove 58 whereas the ring-like shaping insert 50 forms the annular groove 60.

As will be appreciated from viewing FIG. 1, the cross-sectional configuration of the cavity 26 is not the same as the cross-sectional configuration of the cavity 26 after compaction as shown in FIG. 3. In other words, the cross section of the cavity 26 as shown in FIG. 1 is different than a cross section of the compact 52 as shown in FIG. 4. As the plug 18 moves downwardly there is linear or straight compaction of the powder within the cavity 26. Since there is less thickness of powder beneath the annular ring 50 than there is between the annular ring 50 and the annular ring 48 there will be less compaction under the ring 50 and therefore a requirement of less movement of the ring 50 than the ring 48. As the plug 18 initially moves downwardly, the projection 34 on the shaping insert 30 is deformed to prevent bulging of the cylindrical insert 30 which would occur if the plug 18 directly engages the top of the insert 30. As the plug 18 moves downwardly, powder is compacted between the top of the annular ring 48 and the bottom surface of the plug 18 until the desired compaction occurs whereafter the force becomes sufficient to overcome the press fit of the annular ring 48 about the cylindrical insert 30 to move the annular ring-like insert 48 downwardly to compact powder against the lower annular ring-like insert 50 after which the force becomes sufficient on the annular ring 50 to break the press fit and move the annular ring 50 downwardly to compact powder therebeneath. As the plug 18 is moving downwardly, powder is compacted between the inserts 36 and 38 until the force becomes sufficient to deform the ribs 44 and 46 allowing the inserts 36 and 38 to move relative to the walls in which they are supported thereby compacting powder under the annular flanges.

Compaction is linear or straight line until the ram 16 and the plug 18 reach the position shown in FIG. 3 where all of the shaping inserts have moved to the pre-calculated positions and further compaction takes place isostatically as the ram 16 engages the top of the container 12 which is subjected to temperatures sufficient to densify the powder metal compact and experiences plastic flow resulting in isostatic compaction of the article 52.

Thus, in accordance with the subject invention, there is provided a method of hot consolidating powder by heat and pressure in a container mass 12 which is substantially fully dense and incompressible with at least a portion capable of plastic flow at pressing temperatures and having interior walls 28 forming a closed cavity 26 of a predetermined shape and volume for receiving powder with the interior walls being movable to reduce the volume of the cavity 26 for compacting the powder into an article and wherein the method comprises the steps of disposing a shaping means comprising one or more of the floating shaping inserts 30, 36, 38, 48 or 50 in the cavity 26 for defining voids in the article 52 as the powder is compacted thereagainst and applying a force to the container to reduce the volume of the cavity 26 and allowing relative movement between the shaping inserts 30, 36, 38, 48 and 50 and at least portions of the interior walls of the cavity 26 as powder is compacted against the shaping inserts in response to a force reducing the volume of the cavity 26.

In accordance with the method, a force is applied to the container 12 while allowing the relative movement between the shaping inserts and the container wall until a predetermined degree of compaction has taken place, as illustratd in FIG. 3, at which point the mass of the container 12 becomes substantially monolithic so that further application of the force by the ram 16 causes further compaction as a result of fluid-like behaviour of the mass of the container 12 due to the plastic flow of the mass of the container 12 whereby further compaction is isostatic. Of course, the container 12 and the powder therein is heated to a temperature at which the powder will densify as pressure is applied to the powder as a result of the force applied to the container 12 by the ram 16.

Figure 5:
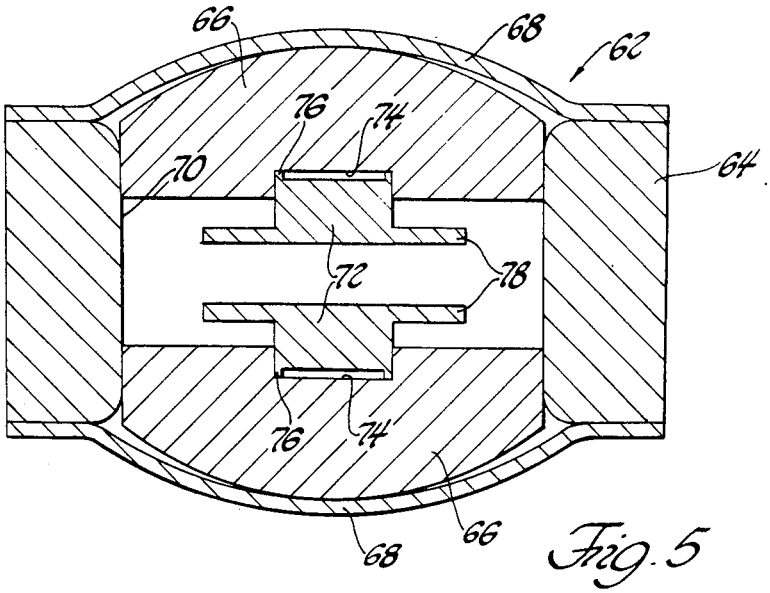
FIG. 5 is a cross-sectional view taken centrally through a container having floating shaping inserts therein for disposition in an autoclave to apply gas pressure about the container.
Figure 6:
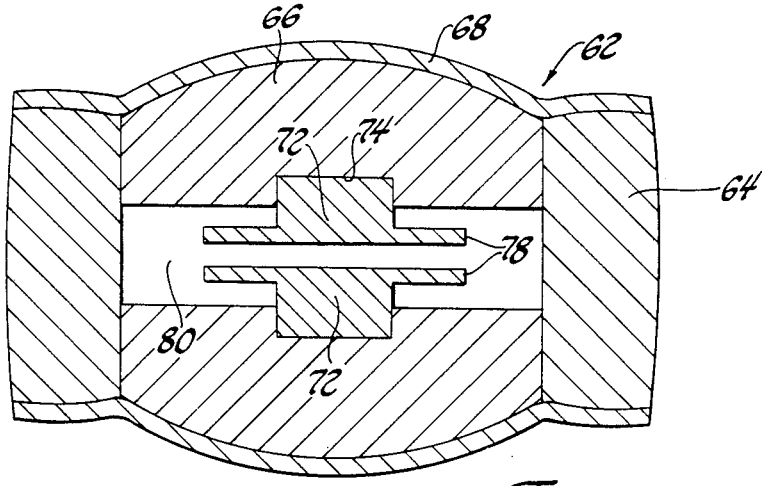
FIG. 6 is a view similar to FIG. 5 but showing the container after consolidation has taken place by gas being applied thereto in an autoclave.
Figure 7:
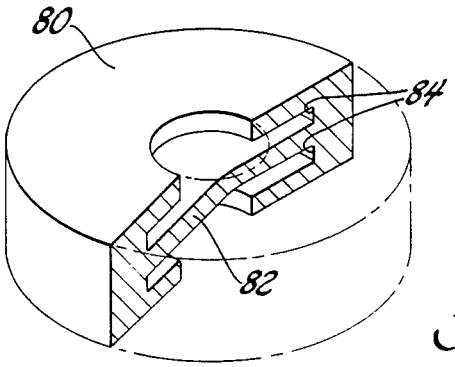
FIG. 7 is a perspective view partially cut away and in cross section showing the compact or article resulting from the container as shown in FIG. 6.

FIGS. 5 and 6 disclose an alternative assembly wherein the container has force applied thereto by applying gas pressure in a gas autoclave. Specifically, the container is generally shown at 62 in FIG. 5 in the pre-compact state. The container 62 includes an annular wall 64 with circular domed disc-like members 66 disposed within the annular ring 64. Circular domed plates 68 are welded to the top and bottom respectively of the annular ring 64. Appropriate passages (not shown) extend through the walls to insert powder into the cavity 70 defined by the container 62.

Also included are the identical top and bottom floating shaping inserts 72. The inserts 72 are disposed in recesses 74 in the interior walls of the cavity 70. The force-responsive means associated with the inserts 72 are deformable projections defined by annular circular ribs 76.

The container 62 is placed in an autoclave wherein gas pressure is applied to the container about all surfaces thereof whereby the mass material of the container 62 undergoes plastic deformation or flow and acts as a fluid container to reduce the volume of the cavity 70. The annular disc-like members 66 are domed so as to provide increased strength at the center thereof to prevent the center from moving inwardly farther or faster than the periphery of the disc-like members adjacent the annular ring 64. As the annular disc-like members 66 move toward one another compaction of the powder between the shaping inserts 72 occurs until the force is sufficient to deform the ribs 76 whereby the inserts 72 move relative to the walls of the cavity 70 compressing the powder between circular flanges 78 of the inserts and the interior walls defined by the disc-like members 66.

The compaction occurs until the container reaches the configuration shown in FIG. 6 to produce the compact or article 80. The container 62 is removed by machining, leaching or one of many known processes from the compact or article 80 which is shown in FIG. 6. As will be appreciated, the space between the inserts 72 defines the wall 82 of the compact 80 and the flanges 78 of the shaping inserts 72 define the annular grooves 84.

Thus, the force supplied to container 62 is by applying a gas pressure in a gas autoclave to the container 62 as shown in FIG. 5 whereby the container moves to the configuration shown in FIG. 6 to produce the near net shape and in so doing the floating shaping inserts 72 move relative to the walls of the cavity to produce the desired near net shape.

The invention has been described in an illustrative manner, and it is to be understood that the terminology which has been used is intended to be in the nature of words of description rather than of limitation.

Obviously, many modifications and variations of the present invention are possible in light of the above teachings. It is therefore, to be understood that within the scope of the appended claims, the invention may be practiced otherwise than as specifically described.

The embodiments of the invention in which an exclusive property or privilege is claimed are defined as follows:

1. A method of hot consolidating powder in a heat container mass which is substantially fully dense and incompressible with at least a portion capable of plastic flow during pressing and having interior walls forming a closed cavity of a predetermined shape and volume for receiving powder with the interior walls being movable to reduce the volume of the cavity for compacting powder into an article comprising the steps of: disposing a shaping means in the cavity for defining a void in the article as the powder is compacted thereagainst, applying a force to the container to move the interior walls relative to one another to reduce the volume of the cavity while compacting the powder with a force response means between the shaping means and at least a portion of the interior walls of the cavity to prevent movement of the shaping means relative to that portion of the interior walls as the cavity is reduced in volume until the powder thereagainst reaches a predetermined degree of compaction whereupon movement of the shaping means relative to that portion of the interior walls is allowed as the cavity is further reduced in volume to complete the compaction of the powder, and applying a force to the heated container until the mass of the container becomes substantially monolithic so that further application of the force causes further compaction as a result of fluid-like behaviour of the mass of the container due to the plastic flow of the mass of the container whereby the further compaction is isostatic.

2. A method as set forth in claim 1 further defined as applying the force to the container by applying gas pressure in a gas autoclave.

3. A method as set forth in claim 1 further defined as applying the force to the container by pressing the container between the dies of a press while restraining the container to cause the plastic flow of the container mass.

* * * * *